United States Patent [19]

McCauley et al.

[11] Patent Number: 4,972,197

[45] Date of Patent: Nov. 20, 1990

[54] INTEGRAL HEATER FOR COMPOSITE STRUCTURE

[75] Inventors: Donald D. McCauley, Los Altos Hills; John D. Bayless, Jr., Cupertino, both of Calif.

[73] Assignee: Ford Aerospace Corporation, Newport Beach, Calif.

[21] Appl. No.: 303,071

[22] Filed: Jan. 30, 1989

Related U.S. Application Data

[63] Continuation of Ser. No. 92,844, Sep. 3, 1987, abandoned.

[51] Int. Cl.[5] ..... H01Q 1/02

[52] U.S. Cl. ..... 343/704

[58] Field of Search ..... 219/209, 219, 528, 543, 219/548, 549; 343/704, 912

[56] References Cited

U.S. PATENT DOCUMENTS

| | | | |
|---|---|---|---|
| 2,679,003 | 5/1954 | Dyke | 250/33.65 |
| 2,712,604 | 7/1955 | Thomas | 250/33 |
| 2,864,927 | 12/1958 | Veldhuis | 219/19 |
| 3,146,449 | 8/1964 | Serge | 343/704 |
| 3,805,017 | 4/1974 | Roberts | 343/704 |
| 4,259,671 | 3/1981 | Levin | 343/704 |
| 4,429,216 | 1/1984 | Brigham | 219/548 |
| 4,536,765 | 8/1985 | Kaminski | 343/704 |

FOREIGN PATENT DOCUMENTS

| | | | |
|---|---|---|---|
| 2832119 | 2/1979 | Fed. Rep. of Germany | 219/209 |
| 2426343 | 1/1980 | France | 343/704 |
| 57-65006 | 4/1982 | Japan | 343/704 |
| 0065007 | 4/1982 | Japan | 343/704 |

*Primary Examiner*—William L. Sikes
*Assistant Examiner*—Robert E. Wise
*Attorney, Agent, or Firm*—Edward J. Radlo; Keith L. Zerschling

[57] ABSTRACT

A heater for a composite structure (2) is integrally formed as part of the structure (2) itself. The structure (2) comprises a layer of conductive fibers (30), such as a carbon felt mat, embedded in a nonconductive matrix (31). Electrodes (11, 12) inject an electrical current through multiple paths (15) through the conductive fibers (30), whereby the fibers (30) convert the electrical current to heat energy. Thus, the fibers (30) serve the dual roles of structural support to the composite structure (2) and heat converters. The composite structure (2) can be a portion of or an entire paraboloidal antenna reflector (6), in which case the heater of the present invention prevents and removes ice and snow build-up thereon. Cutting slits (8) into the composite structure (2) is a technique which can be used to vary the heat distribution within the structure (2). The slits (8) are positioned according to the shape of the structure (2) and the location of the current injecting electrodes (11, 12).

7 Claims, 2 Drawing Sheets

INTEGRAL HEATER FOR COMPOSITE STRUCTURE

This is a File Wrapper Continuation application of U.S. patent application Ser. No. 092,844, filed Sept. 3, 1987, now abandoned.

TECHNICAL FIELD

This invention pertains to the field of heating composite structures. In the special case where the composite structure is an antenna reflector, the invention prevents and removes ice and snow build-up from the reflector.

BACKGROUND ART

In one category of heating antenna reflectors, which may or may not be composite structures, elongated heating wires or strips are used. Unlike in the present invention, in which the heating fibers form part of the composite structure itself, the heating elements in these prior art references do not play any structural role, and in fact have a structural detriment. Examples of this category of prior art are: U.S. Pat. Nos. 2,679,003; 2,712,604; 2,864,927; and 3,146,449; French patent publication No. 2,426,343; and Japanese patent reference No. 57-65006. Compared with these references, the integral composite heater of the present invention offers the following advantages:

1. More reliable operation because it does not contain a single point of failure.
2. Avoidance of the delamination and debonding problems of the prior art, because there is only one coefficient of thermal expansion for the structure being heated and the heating means itself.
3. Can be tailored to provide either uniform heating or specified non-uniform heating.
4. Can readily be used on a contoured surface.
5. Utilizes inexpensive materials and techniques.
6. Immunity to puncture damage.
7. Employs voltages in safer ranges, because the resistance through the heating fibers is lower than in the wires of the prior art.
8. Greater immunity to EMP (electromagnetic pulses), because the heating means is homogeneous.
9. Maintenance-free operation.
10. Greater heating uniformity because of the continuous nature of the heating elements.

In a second approach to heating antenna reflectors, as exemplified by U.S. Pat. No. 4,259,671, hot air is used to heat the reflector.

U.S. Pat. No. 4,536,765 shows the use of a non-stick coating to prevent ice and snow build-up on an antenna reflector.

In a fourth approach of the prior art, a metallic spray, such as Spraymat (TM) manufactured by Lucas Aerospace, is sprayed on a surface to be heated. An electrical current is then passed through the spray to heat the surface. Compared with the present invention, this technique is very expensive and fragile.

Finally, U.S. Pat. No. 3,805,017 combines the techniques of heating wires and a thermally conductive but electrically nonconductive spray.

Disclosure of Invention

The present invention is a heater for a composite structure (2). The composite structure (2), is made of a layer of electrically conductive fibers (30) embedded in an electrically nonconductive matrix (31). The heater comprises means (11, 12) for injecting an electrical current through multiple paths (15) through the conductive fibers (30), whereby the fibers (30) convert the electrical current to heat energy. The fibers (30) provide structural support to the composite structure (2) as well as act as heat converters.

Brief Description of the Drawings

These and other more detailed and specific objects and features of the present invention are more fully disclosed in the following specification, reference being had to the accompanying drawings, in which.

Best Mode for Carrying Out the Invention

Figure 1:
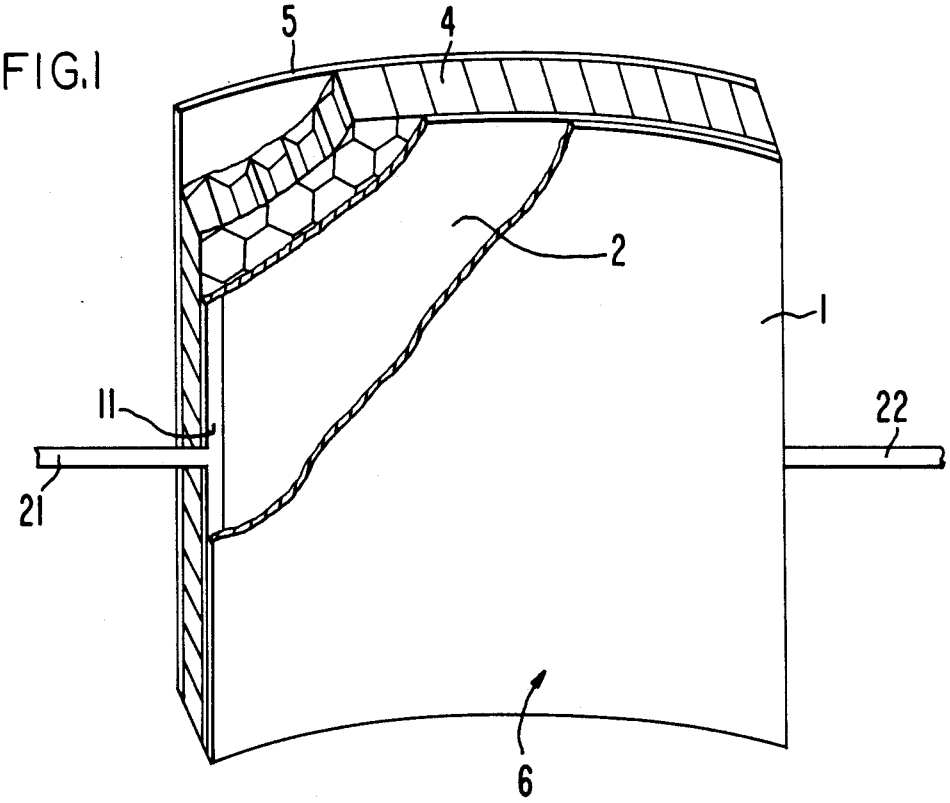
FIG. 1 is an isometric view of a portion of a paraboloidal antenna reflector 6 utilizing the present invention.

FIG. 1 illustrates the special case where the invention is used to heat a composite structure 2 that forms a portion of a paraboloidal antenna reflector 6. It must be remembered, however, that the present invention can be used in conjunction with any composite structure 2.

Reflector 6 comprises a lightweight honeycomb or other core 4 sandwiched between a back skin 5 and a composite front skin 2. Sprayed or otherwise positioned on the front surface of front skin 2 is a metallic layer 1 which reflects electromagnetic energy in desired directions, enabling the antenna to function. An insulating material, such as FM 300 film adhesive or Kevlar, can be interposed between the heated composite structure 2 and the reflective layer 1, in order to prevent current discharge through layer 1.

Alternative to the sandwich structure depicted in FIG. 1, composite structure 2 could constitute the entire antenna reflector 6.

Composite structure 2 consists of a layer of electrically conductive fibers 30 embedded in an electrically nonconductive matrix 31. The conductive fibers 30 are typically carbon, preferably in the form of a carbon felt mat. By a felt mat is meant that the fibers 30 are discontinuous and have a random orientation. A felt mat having a thickness of 0.05 inch was found to be suitable in a laboratory prototype. Such a felt mat can be formed into a nonplanar shape without buckling or folding.

Alternatively, the conductive fibers 30 can be in the form of a closely woven fabric. This fabric can be, for example, T300 carbon, which has a medium modulus. Higher modulus fibers were found to be too conductive for use as practical heating elements.

The second ingredient in the composite structure is an electrically nonconductive matrix 31. The matrix 31 is typically an epoxy, phenolic, or polyamide resin; or a ceramic. 934 epoxy resin manufactured by Fiberite was successfully used in the aforesaid prototype.

Figure 2:
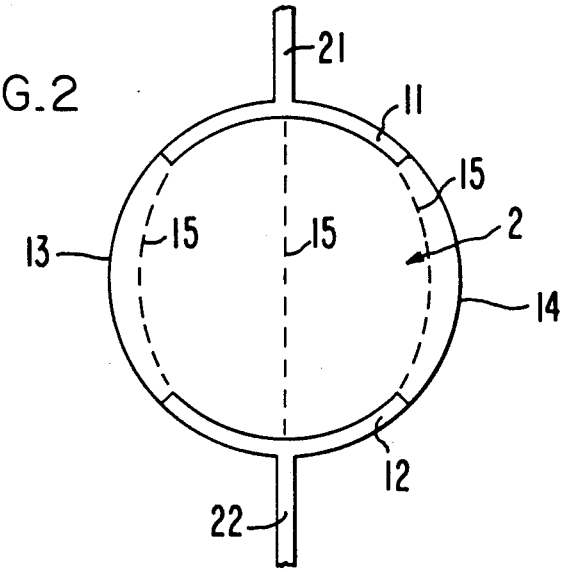
FIG. 2 is a top planar view of a circular or paraboloidal composite structure 2 utilizing the present invention.

In FIG. 2, we see that first and second electrodes 11, 12 are positioned at opposing ends of structure 2 for purposes of injecting an electrical current through multiple paths 15 through the electrically conductive fibers 30. Only a small number (three in FIG. 2) of the multiple paths 15 are illustrated in the drawings, but in reality the number of paths 15 is very high, e.g., in the thousands or millions. Current is supplied to electrodes 11, 12 via electrical conductors 21, 22, respectively, which have a lower resistivity than that of the conductive fibers 30.

The term "opposing ends" is a function of the geometry of the composite structure 2 being heated. In FIG. 2, where the geometry is circular or paraboloidal, it is seen that electrodes 11, 12 are arcuate in shape and preferably occupy 50% of the circumference of the planar projection of composite structure 2. Arcs 13 and 14 are considered to be adjacent rather than opposing to arcs 11 and 12, and together comprise the remaining 50% of the circumference of circle 2.

Figure 3:
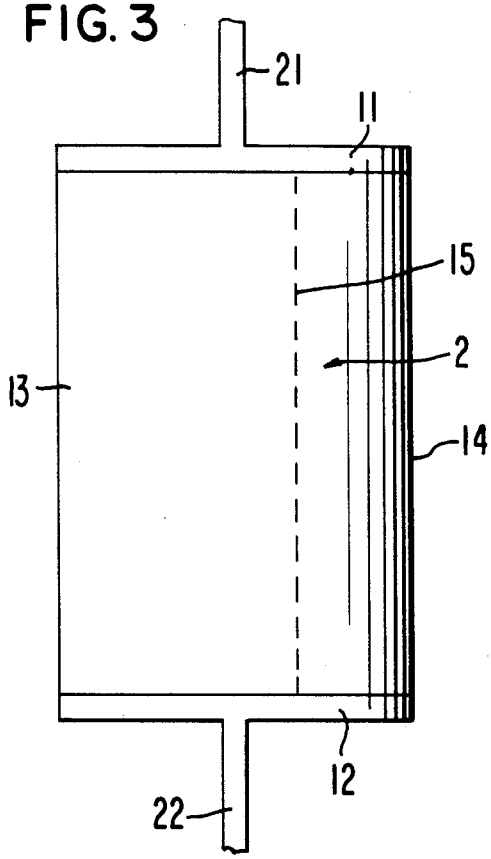
FIG. 3 is a top planar view of a rectangular composite structure 2 utilizing the present invention.

In FIG. 3, structure 2 has a rectangular planar projection, so the definition of "opposing ends" is more straightforward. As shown in FIG. 3, electrodes 11 and 12 are positioned at the short opposing ends of rectangle 2. Alternatively, electrodes 11, 12 could be positioned at the long opposing ends 13, 14 of rectangle 2.

Figure 4:
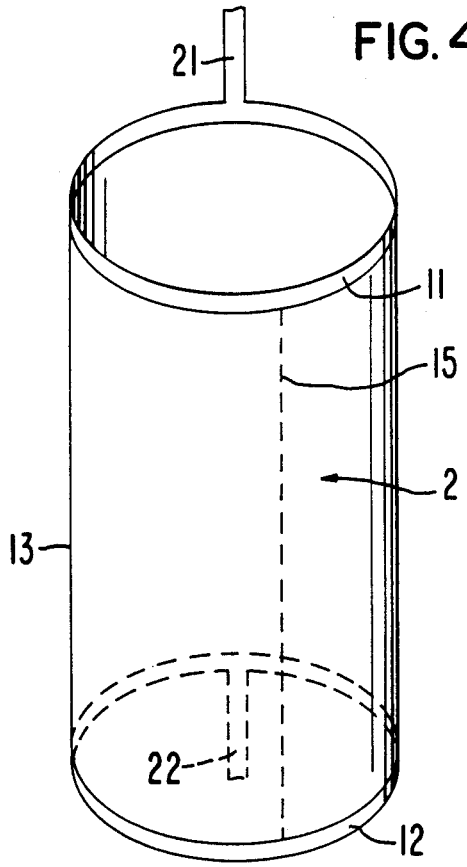
FIG. 4 is an isometric view of a cylindrical composite structure 2 utilizing the present invention.

In the right circular cylindrical geometry depicted in FIG. 4, electrodes 11, 12 are annular and are located at the circular ends of the cylinder. Surface 13 is considered to be adjacent to, rather than opposing, each of the circular ends.

Independent of the particular geometry, the current passing through electrodes 11, 12 can be either alternating or direct. Normally the voltage between electrodes 11, 12 is fixed, based upon the desired amount of current passing through the fibers 30 (which is a function of the required heating) and the resistivity of the fibers. Power densities in the range of one-half to one watt per square inch are normally considered desirable for the application of heating antenna reflectors 6. This results in a voltage differential between electrodes 11, 12 of approximately 35 volts for the resistivities typically associated with the fibers described herein.

In general, electrodes 11, 12 should satisfy the following criteria:

1. They be positioned at opposing ends of composite structure 2.
2. They be generally of the same size.
3. They each be spread over a relatively large linear dimension of an opposing end.
4. They launch the current in a substantially uniform manner.
5. They not cover much area of the composite structure 2, because this would be wasted (electrodes 11, 12 do not contribute to the heating).
6. The resistance between the electrodes 11, 12 and the conductive fibers 30 be as low as possible. This can be accomplished by, for example, fabricating each electrode 11, 12 out of a pair of metallic plates which are clamped together surrounding the layer of conductive fibers 30 before structure 2 is finally cured.

Figure 5:
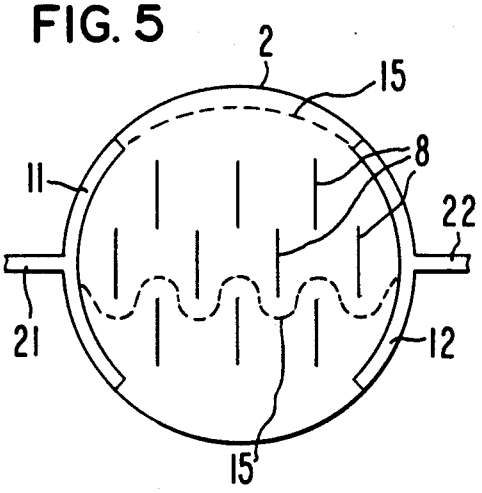
FIG. 5 is a planar view of a composite structure 2 utilizing the present invention wherein slits 8 are positioned to provide uniform heating.
Figure 6:
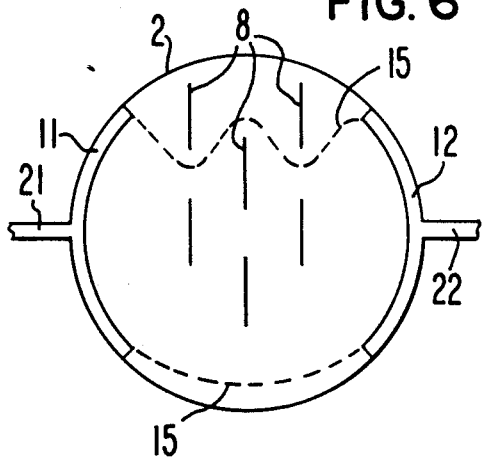
FIG. 6 is a planar view of a composite structure 2 utilizing the present invention in which slits 8 have been positioned to provide nonuniform heating.

FIGS. 5 and 6 show how cutting a pattern of slits 8 into composite structure 2 can be used to regulate the uniformity of the heating throughout structure 2. If the precursor of structure 2 is a prepreg (less than totally cured composite), slits 8 are cut during the layup of the prepreg, i.e., before final cure of structure 2. The nonconductive matrix material 31 then fills slits 8, lending structural integrity. Slits 8 work on the basis that the electrical current density (current per unit volume) within structure 2 is proportional to the heating generated by that volume of structure 2. When slits 8 are present, the length of a neighboring heating path 15 increases; therefore, the resistance of the path 15 increases and the current density for that path 15 decreases (owing to Ohm's law, since the voltage differential between electrodes 11, 12 is fixed). Therefore, the amount of heating produced along that path 15 decreases.

FIG. 5 illustrates a configuration of slits 8 amenable to uniform heating throughout structure 2. This is because the presence of the slits 8 forces paths such as the illustrated central path 15 to be approximately equal in length to paths such as the illustrated path 15 located near the periphery. In other words, the resistance through the central paths 15 has been artificially increased.

FIG. 6, on the other hand, shows a distribution of slits 8 that is amenable to producing more heating at the bottom of structure 2 than at the top, inasmuch as the slits are skewed towards the top of structure 2. The illustrated path 15 near the bottom is shorter than the illustrated path 15 near the top. Therefore, the current density in the lower path 15 is higher than in the upper path 15. It follows that more heating is produced for the lower path 15.

In general, the slits 8 are positioned according to the shape of the structure 2 and the location of the current injecting electrodes 11, 12.

A second technique can be used, either alone or in combination with the slits 8, to produce nonuniform heating. This second technique is to increase the thickness of the layer of conductive fibers 30 in regions where it is desired to produce more heating.

The above description is included to illustrate the operation of the preferred embodiments and is not meant to limit the scope of the invention. The scope of the invention is to be limited only by the following claims. From the above discussion, many variations will be apparent to one skilled in the art that would yet be encompassed by the spirit and scope of the invention.

What is claimed is:

1. A heater for a composite structure made of a layer of a multitude of lossy electrically conductive elongated fibers embedded in an electrically nonconductive matrix, said fibers and said matrix synergistically contributing to the strength of said composite structure, said heater comprising:

means for injecting an electrical current through multiple paths of the conductive fibers, whereby the fibers convert the electrical current to heat energy; wherein the fibers provide structural support to the composite structure by virtue of being an integral part thereof, as well as act as heat converters.

2. The heater of claim 1 wherein the composite structure is electromagnetically opaque, and simultaneously supports and heats a paraboloidal antenna reflector requiring heating;

the heat-providing composite structure is in intimate contact with substantially all of a surface of the antenna reflector; and heating of the composite structure provides contiguous and uniform heating of the antenna reflector and prevents and removes ice and snow build-up from the antenna reflector.

3. The heater of claim 1 wherein the conductive fibers are fabricated of carbon.

4. The heater of claim 3 wherein the conductive fibers are randomly oriented in a felt mat of discontinuous fibers.

5. The heater of claim 1 wherein the nonconductive matrix is fabricated of a material from the class of materials consisting essentially of epoxy resins, phenolic resins, polyamide resins, and ceramics; and the composite structure is mechanically self-supporting.

6. The heater of claim 1 wherein the injecting means comprises first and second electrodes positioned at opposing ends of the composite structure, wherein:

the first and second electrodes are generally of the same size, are each spread over a relatively large linear dimension of the corresponding end, and launch current in a substantially uniform manner.

7. The heater of claim 1 wherein the composite structure has been cut by narrow elongated slits that are generally evenly distributed throughout a surface of the composite structure and are generally orthogonal to said multiple paths;

whereby the slits tend to equalize the current densities through the multiple paths and thereby equalize the heating distribution throughout the composite structure.

* * * * *